United States Patent [19]

Honig

[11] Patent Number: 4,809,401

[45] Date of Patent: Mar. 7, 1989

[54] DRAPERY POLE INSTALLATION SYSTEM

[76] Inventor: Michael R. Honig, 15934 Pinyon Creek Dr., Houston, Tex. 77095

[21] Appl. No.: 37,624

[22] Filed: Apr. 13, 1987

[51] Int. Cl.[4] ..... A47H 1/022; A47H 1/102; A47H 1/142

[52] U.S. Cl. ..... 16/87.2; 211/105.2; 211/105.3; 248/263; 248/265; 403/297; 403/298; 403/295

[58] Field of Search ..... 16/87 R, 87.2, 87.4, 16/95; 160/126, 330, 340, 341; 211/105.1, 105.2, 105.3, 105.4, 105.5, 105.6; 248/222.2, 224.4, 261, 262, 265; 403/292, 297, 298, 295, 364

[56] References Cited

U.S. PATENT DOCUMENTS

| | | | |
|---|---|---|---|
| Re. 27,086 | 3/1971 | Graber et al. | 160/345 |
| 210,084 | 11/1878 | Blake | 211/105.1 |
| 563,592 | 7/1896 | Hilliker | 16/87.4 |
| 674,752 | 5/1901 | Baker | 403/292 |
| 705,296 | 7/1902 | Richards | 211/105.3 |
| 872,689 | 12/1907 | Sarkisian | 211/105.2 |
| 1,055,925 | 3/1913 | Lathrop | 248/262 |
| 1,077,083 | 10/1913 | Kroder | 248/262 |
| 1,077,529 | 11/1913 | Griffin | 160/330 |
| 1,488,257 | 3/1924 | Kirsch | 248/262 |
| 1,910,555 | 5/1933 | Marlowe | 211/105.4 |
| 2,385,608 | 9/1945 | Castagna | 403/109 |
| 2,617,537 | 11/1952 | Henley | 211/105.2 |
| 2,647,644 | 8/1953 | Cieslik | 211/105.6 |
| 2,778,030 | 1/1957 | Goche | 160/330 |
| 2,848,769 | 8/1958 | Oakley | 52/726 |
| 3,000,656 | 9/1961 | Holleander | 403/292 |
| 3,079,005 | 2/1963 | Bednar | 211/96 |
| 3,661,272 | 5/1972 | Panni | 211/105.1 |
| 3,881,218 | 5/1975 | Palmer | 16/93 D |
| 3,932,048 | 1/1976 | Du Pont | 403/298 |

FOREIGN PATENT DOCUMENTS

| | | | |
|---|---|---|---|
| 596292 | 10/1925 | France | 211/105.3 |

*Primary Examiner*—Fred Silverberg
*Assistant Examiner*—Edward A. Brown
*Attorney, Agent, or Firm*—Gunn, Lee & Jackson

[57] ABSTRACT

A drapery pole installation system is provided having an elongated generally cylindrical drapery pole forming an elongated slot extending the length thereof. Intermediate support for the drapery pole is provided by one or more intermediate hangers adapted to extend from a wall structure of a building with fingers extending in supporting relation within the elongated slot of the drapery pole. End support for the drapery pole is provided by elbows which are supported by substantially concealed brackets and which effectively compensate for slight errors in drapery pole measurement. The drapery support elbows have hollow receptacles at one end and support apertures that receive support pins of the wall mounted brackets.

19 Claims, 3 Drawing Sheets

DRAPERY POLE INSTALLATION SYSTEM

This invention relates generally to drapery support systems and more specifically concerns a drapery pole system having elbows which extend from wall mounted brackets and support an elongated generally cylindrical pole in spaced relation with the wall. The drapery pole is effectively adapted to accommodate errors in measurement of the length thereof. The invention also includes compression retained drapery poles and poles for other purposes as well as brackets and fittings for installation thereof.

BACKGROUND OF THE INVENTION

Existing components utilized for the installation of shirred (gathered) drapes on drapery poles are basic and long standing. Typically, a 1⅜ths diameter pole is cut to the desired length and hung on a wall using metal brackets, wooden brackets, wooden elbows, or some combination of these installation elements. Installation is painstaking since all measurements are precise. Installation will be difficult or impossible if the drapery support pole is of insufficient or excessive length. Obviously, if the drapery support pole is of insufficient length it frequently may need to be discarded and a new pole measured and cut. Precise measurement is time consuming and expensive and the waste of discarded drapery poles further adds to the expense and inefficiency of existing drapery pole systems. In the event a drapery pole must be supported intermediate its length one or more intermediate support brackets are affixed to the wall structure and are secured in supporting relation with the drapery pole. In this case openings must be cut into the drapes to permit support arms to extend through the drapes Obviously, improper measurement or cutting of holes in the drapes can ruin an expensive drape Other drapery installation components which may be used include screw-on finials, screw-in splices, angle brackets, rings, etc. Screw-in components are laborious and time consuming to connect. Also, the typical components utilized in this sort of installation are relatively expensive. It is desirable therefore to provide a drapery pole installation system which effectively compensates for accuracy of drapery pole measurement and cutting and which can be simpler, faster and less expensive to install as compared with conventional drapery support systems.

SUMMARY OF THE INVENTION

It is therefore a principal feature of the present invention to provide a novel drapery support pole installation system which utilizes a drapery pole connection structure that compensates for slight error in measurement and cutting and thereby permits faster and simpler installation of the drapery pole system.

It is also a feature of this invention to provide a novel drapery pole construction which enables the drapery pole to be supported intermediate its length without necessitating cutting of the drape, even when the drapery support structure is intended to be inconspicuous.

It is an even further feature of this invention to provide a novel drapery pole installation system wherein the drapery pole member can be formed of two or more sections of drapery pole that are assembled by means of adjustable splices and connections to thereby insure simplicity and efficiency of installation without detracting from the structural integrity of the drapery support system.

It is also a feature of this invention to provide a novel drapery pole support system employing decorative elbow support members which are attached to wall brackets whereby the bracket is substantially concealed and wherein connection between the elbow and the drapery pole is provided by means of a novel sleeved or spliced connection permitting linear adjustment to compensate for nominal inaccuracies in the length of the drapery pole.

It is an even further feature of this invention to provide a novel drapery pole installation system wherein the pole is designed for cutting by means of a mechanical pole cutter and wherein rigging may be designed so that a form of finger joint or other connecting device is used to "plug in" modules such as splices, elbows, finials, etc. and wherein the "play" in the way these modules fit together would reduce the degree of precision necessary in measuring and cutting.

It is also a feature of this invention to provide a novel support pole construction which may be simply and efficiently installed for supporting articles other than draperies.

It is another feature of this invention to provide a novel support pole construction incorporating a splice system enabling it to have limited linear adjustability to compensate for minor errors in measurement and resulting in a support pole installation wherein the splice joint has structural integrity equal to that of other portions of the support pole.

Briefly, the present invention incorporates a basic support component in the form of an elongated drapery pole member which is preferably in the form of an extruded plastic or metal tube with internal ribbing to provide rigidity for effective support of draperies and other articles. For simplicity the pole construction is referred to herein as a drapery pole though it may be employed to support other articles as well. The drapery pole member may also be composed of wood or any other suitable material formed to define an elongated slot extending from end to end. Under circumstances where the drapery pole must be provided with intermediate support, the structure of the drapery pole would allow a standard type center support (which is usually used for conventional metal curtain rods) to be used without the need to cut into the drapery rod pocket of the drapery. This would result in nearly a 50% saving over the kind of drapery support bracket currently in use.

In the case of an extruded plastic or metal drapery support pole, the slot and pole interior would be designed so that a mechanical pole cutter could be used to cut the pole to the desired length. Currently, it is necessary to use a hacksaw or similar cutting device to cut drapery poles to length. This is a time consuming, tiring and messy operation (spreading sawdust on the carpet which then must be cleaned). The savings permitted by the drapery support installation system in time and effort would obviously result in a lower priced, completely satisfactory installation for the ultimate benefit of the customer.

The internal ribbing of the drapery pole is designed so that a form of finger joint or other connecting device could be used in "plug in" modules such as splices, elbows, finials, etc. Also wood pole sections may also be effectively employed with connector devices such as sleeve splices, splined splices etc. being utilized to secure the pole sections in assembly without detracting from the structural integrity of the drapery support system. By making all components out of extruded or molded plastic stock using a common "plug in" design, a variety of configurations become possible. Projection from the wall can be easily adjusted by changing components or cutting pole sections on the cutter. From the standpoint of support elbows, the elbow devices are constructed to permit simple, fast and attractive installation while allowing maximum concealment of the hardware. The elbow device is also designed to permit maximum margin for error while permitting a fast and attractive installation. This is accomplished by permitting the use of power tools wherever possible and by allowing joints to slide to the maximum for a greater margin of error.

The drapery support elbows can be fabricated in any fashion deemed appropriate to the material and application (such as internally ribbed or honeycombed for greater structural strength, hollowed out at the ends to facilitate concealment and/or use of various brackets, or hollow throughout as just a few examples). The elbow device can be composed of any one of a number of various materials including (but not limited to) wood, metal or plastic. The elbow can also be hinged (for applications at angles of other than 90°) or in the alternative may be of rigid construction.

The present invention effectively provides flexibility of drapery support design and construction. Mistakes in measurement can easily be corrected by splicing a small section of drapery pole to one that has been cut too short. Different configurations can be quickly tried and altered without significant investment of time or expense. Small remnants of drapery support pole could profitably be used in this manner rather than discarding them as is typically the case.

Drapery support bracketing can be improved since the support elbow structures are designed such that a standard curtain bracket can be used. Such a bracket is not only inexpensive but it can be used in manner to simply "hook on" the drapery pole system to the bracket structures for simple and efficient installation. Additionally, the bracket structure can be almost completely concealed behind the elbow structure thereby resulting in a drapery pole installation of more pleasant appearance as compared to standard installations. Such simplicity would encourage the use of elbows, which are considered to make a more attractive installation. They are currently very expensive and laborious to install.

In the event the elbow devices are composed of plastic, material could be made with texture and color in order to better simulate wood, but at a much reduced cost. Also, the versatility of plastic makes possible a whole range of shapes and colors that are now impractical with natural wood.

By using "splice tubes" or a special screw-on adapter, these components could also be used with conventional wooden components. This would appeal to "wood pole purists". It would also serve in those instances where a portion of the wood pole would be visible, thus making a "genuine wood" look desirable, yet it would allow some of the installation advantages of the improved drapery support system of this invention.

BRIEF DESCRIPTION OF THE DRAWINGS

So that the manner in which the above recited features, advantages and objects of the present invention are attained and can be understood in detail, more particular description of the invention briefly summarized above may be had by reference to the embodiments thereof which are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

In the Drawings

FIG. 1 is a plan view illustrated in partial section, showing a drapery pole installation system constructed in accordance with the present invention:

FIG. 2 is a sectional view of an elbow support device of tubular form representing an embodiment of this invention;

FIG. 3 is an end view of one kind of splined connection for interconnecting pole sections;

FIG. 4 is an exploded view of a splined connection between drapery pole sections;

FIG. 5 is a sectional view of an intermediate support bracket illustrating support of a drapery support pole thereby;

FIG. 6 is a sectional view illustrating assembly of an elbow member to a wall mounted bracket provided therefor;

FIG. 7 is a sectional view taken along line 7—7 of FIG. 6 also showing support of the elbow by means of a concealed bracket;

FIG. 7A is a sectional view similar to FIG. 7 which illustrates a modified wall bracket structure which is completely concealed by the elbow;

FIG. 8 is an exploded view of a drapery pole splice assembly constructed in accordance with the present invention;

FIG. 9 is a side view of a drapery pole support element representing an alternative embodiment of this invention;

FIG. 10 is an end view of the drapery support element of FIG. 9;

Figure 11:
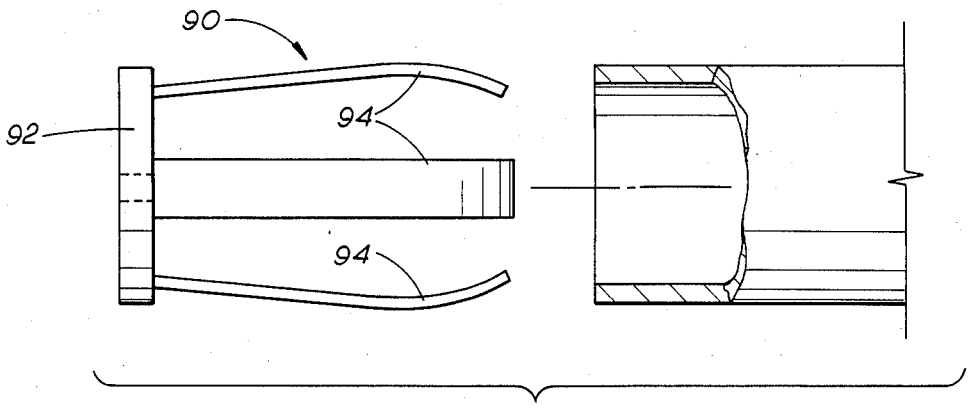
Figure 12:
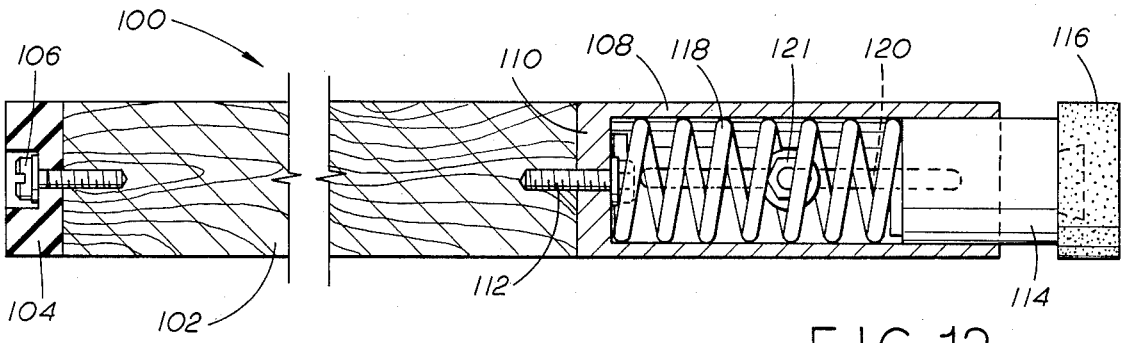
Figure 13:
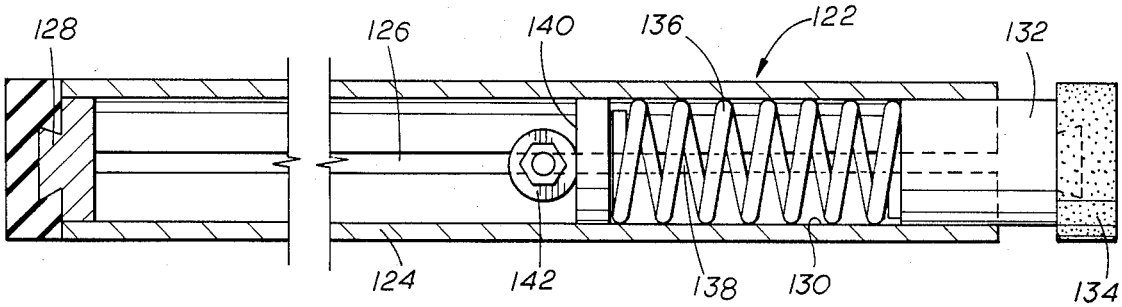
Figure 14:
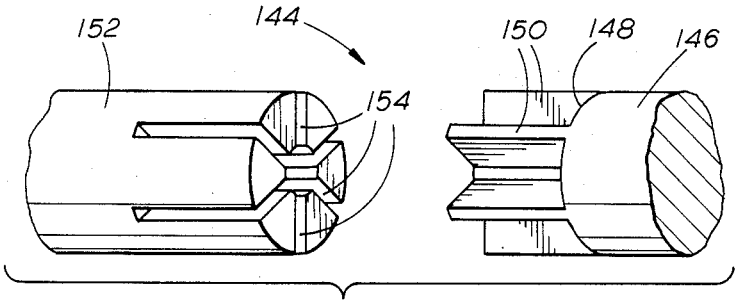

FIG. 11 is a side view of a passive pressure type push on bracket representing another embodiment of this invention;

FIG. 12 is a side view of a support pole of the compression type which represents an alternative embodiment of the present invention;

FIG. 13 is a side view of a compression type support pole representing an alternative embodiment of this invention adapting to the drapery pole embodiment disclosed herein;

FIG. 14 is an isometric illustration of an alternative pole splice; and

Figure 15:
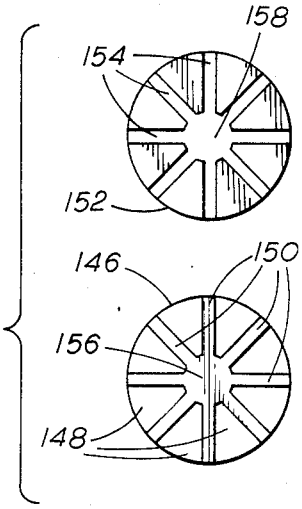

FIG. 15 represents end views of the splice elements of FIG. 14.

DETAILED DESCRIPTION OF THE PREFERRED EMBODIMENT

Figure 1:
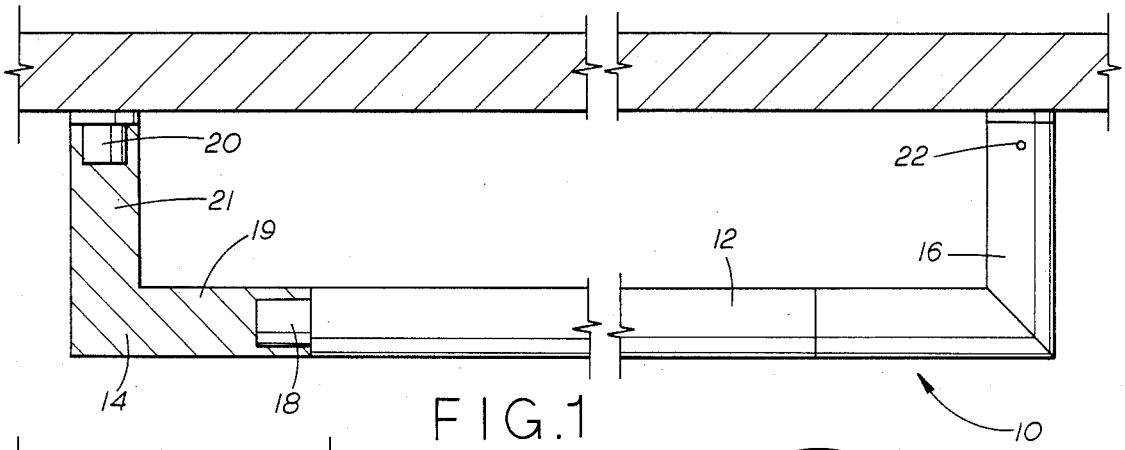

Referring now to the drawings and first to FIG. 1 a drapery support pole assembly is illustrated generally at 10 which includes a drapery support pole 12 extending between and being connected to a pair of elbow members 14 and 16. The connections between the drapery support pole 12 and the elbow members are such that a slight telescopic relation exists between these components which enables compensation for inaccuracies in the length of measurement of the drapery support pole.

As shown at the left hand portion of the Figure, the drapery support elbow 14 defines an internal receptacle 18 which receives an end portion of the drapery support pole 12 in telescoping relation therein or, in the alternative, receives an appropriate splicing device as described hereinbelow. This connection is such that slight telescoping movement can occur between the drapery support pole and the elbow thereby compensating for inaccuracies of measurement of the support pole.

Figure 2:
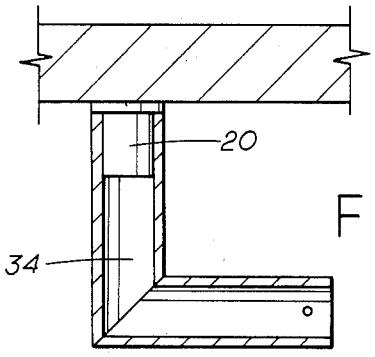
Figure 6:
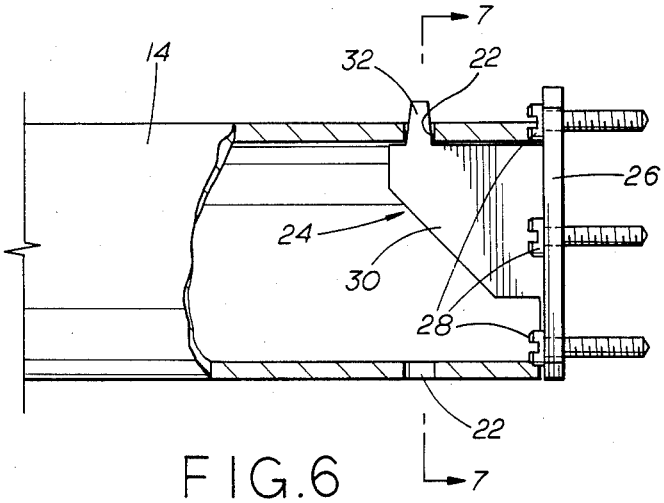
Figure 7:
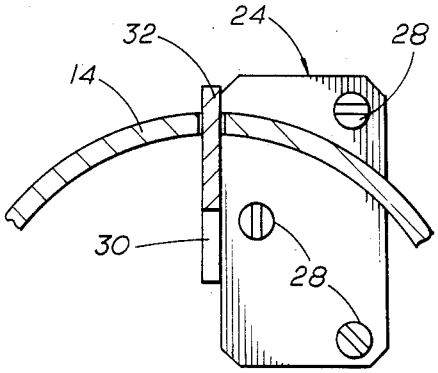
Figure 7A:
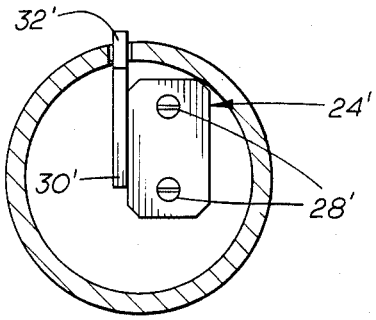

After an appropriate telescoping relationship has been established between the elbow and drapery support pole and splicing device if applicable, a screw or other connecting device may be inserted to secure the members in fixed assembly. The elbow member 14 also is provided with an internal receptacle 20 which forms a thin peripheral wall structure having a connecting aperture 22 such as shown at the right hand portion of FIG. 1. The internal receptacles 18 and 20 are formed to be interchangeable. The elbow legs 19 and 21 could be of differing length to permit choice of projection from the mounting surface. Thus, an aperture such as shown at 22 will be provided at the upper and lower portions of legs 19 and 21. This permits each elbow to be employed for either the "right" or "left" end as shown in FIG. 6. With a drapery support bracket provided such as shown generally at 24 in FIGS. 6 and 7 the elbow member is positively secured by the bracket to the wall structure of the building. The support bracket incorporates a mounting base 26 having openings formed therein to receive screw members 28 for connection of the bracket to a wall structure. From the base member 26 extends a projecting support 30 having a connecting pin 32 at the upper portion thereof. The connecting pin is received by the aperture 22 to establish firm support for the elbow member 14. The bracket 24 is substantially concealed by the elbow supported by the bracket. As shown in FIG. 7A a modified support bracket shown generally at 24' is completely concealed by the elbow except for a small part of the support pins 32'. The elbow member may be of the solid type as shown in FIG. 1 with end receptacles 18 and 20. Alternatively, the elbow may take the form shown at 34 in FIG. 2 wherein it is of tubular form. The angle of the elbow may be sharp or radial (curved) and is designed to accept standard or modified support brackets, system splices, especially designed push-on brackets or other such hardware as is deemed appropriate. Holes are provided at the top and bottom of each end of each elbow for the use of standard curtain brackets. Additional bracket holes may be arranged around the ends as desired. Left and right elbows are interchangeable.

The legs of the elbows are asymmetrical, permitting a choice of broad projections (projection being defined as the distance from the wall to the face of the drapery pole). Greater projections could be obtained by employing larger elbows or splicing additional pieces on the elbows with the splice system set forth herein. Depending on desired application, the elbows can be designed to either slip over the end of a pole in the manner of a sleeve or attached by means of a splice joint such as that set forth herein. Either a conventional wood pole or a tubular pole such as set forth herein may be effectively employed.

Figure 3:
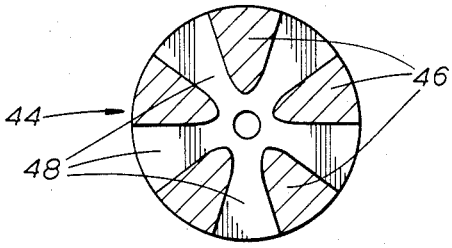
Figure 4:
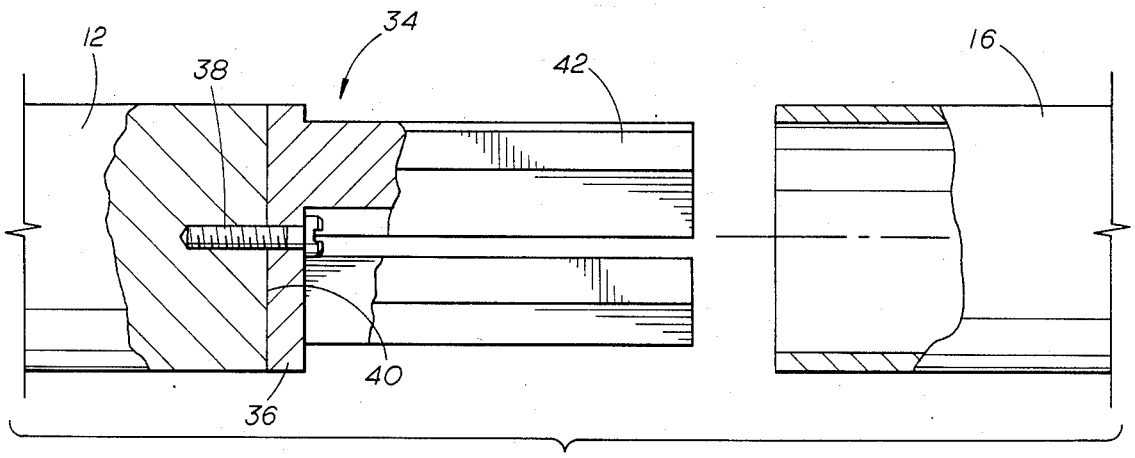

It is desirable to provide a suitable connection enabling elbows and drapery support poles to be interconnected by means of a joint construction having substantially the structural integrity of an unbroken section of drapery support pole. Such a joint connection is illustrated in FIGS. 3 and 4 which represent a preferred embodiment hereof. As shown in FIG. 4 a section of drapery support pole is shown at 12 having a splined structure illustrated generally at 34 which provides an efficient connection between the drapery support pole and an end portion of an elbow member 16. As shown, the splined connection member defines a base or attachment plate 36 having a central aperture adapted to receive a connection screw 38 to secure the attachment plate to an end surface 40 of the drapery support pole. The base 36 is of the same dimension as the dimension of the pole 12 to facilitate centering of the spline at the end of the pole. A plurality of spline fingers 42 extend from the attachment plate and are adapted to be received within the receptacle defined by the tubular elbow 16. Obviously, the elbow may also be of the construction set forth at 14 in FIG. 1 with the splined fingers being received within the receptacle 18. The splined connection illustrated in FIG. 4 may also be utilized in circumstances where adjacent sections of drapery support pole are provided, one section supporting the splined connection 34 while the opposite section is provided with an internal receptacle within which the splined connection is received.

Another form of splined connection is illustrated generally at 44 in FIG. 3. In this case drapery pole sections are provided having mating splined connections with splined fingers 46 that interfit. The opposite splined connection to that shown in FIG. 3 includes splines that are received within finger receptacles 48. The various pole sections are linearly movable thereby enabling slight linear adjustment to accommodate inaccuracies of measurement. The interfitting spline fingers of the spline connections of adjacent drapery pole sections will have exceptional strength substantially equal to that of the drapery support pole itself.

Figure 5:
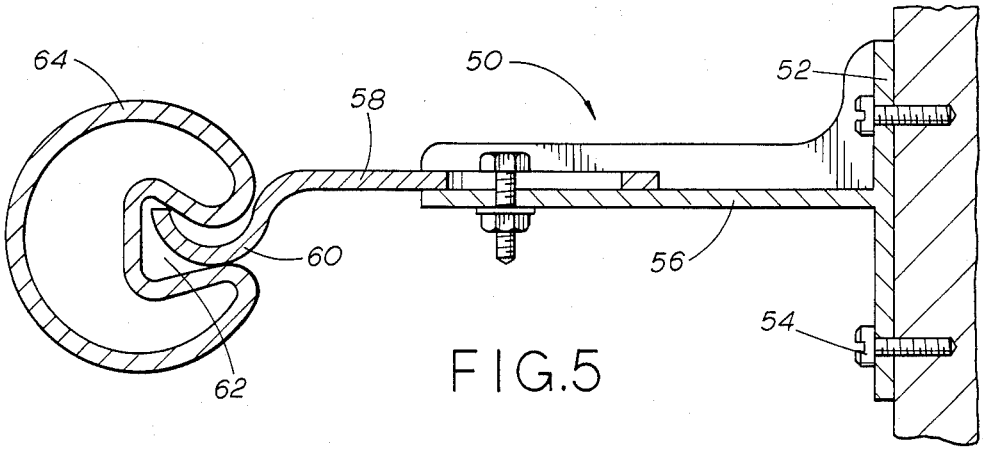

With respect to FIG. 5 an intermediate drapery pole support is illustrated generally at 50 which includes a plate structure 52 adapted to be secured to a wall structure by screws 54. A support channel member 56 extends laterally from the support plate 52 and receives a support arm member 58 in adjustable relation therewith. The support arm is provided with a reverse bent or hook-like extremity 60 which is received within the elongated rear slot 62 of a drapery support pole 64. One or more intermediate support members such as that shown at 50 may be effectively utilized to provide intermediate support for the drapery support pole. In this case, the intermediate support members will be concealed and it will not be necessary to cut openings in the drapery through which drapery supports extend. This feature saves considerable time and labor and thereby effectively reduces the costs to the customer should be borne in mind that support 50 is only one type of commonly available, relatively inexpensive component which can be employed for intermediate support of the drapery pole hereof and that other types may be employed within the spirit and scope of this invention.

Figure 8:
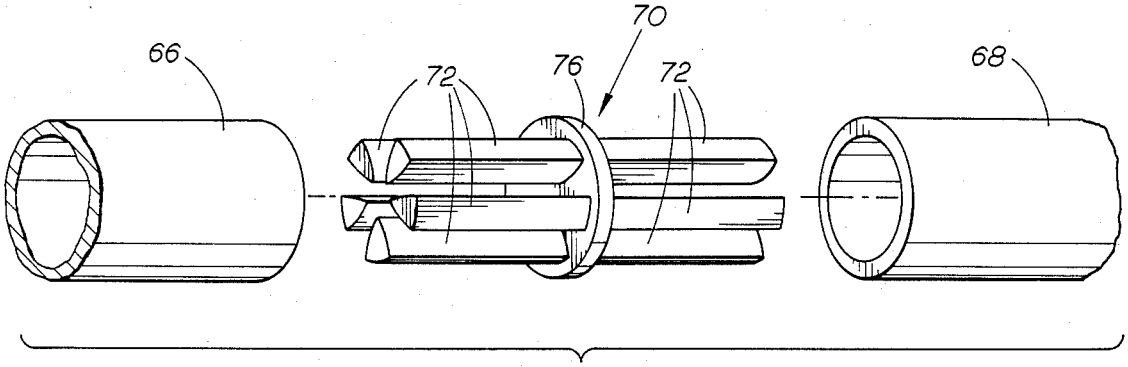

At times it will be appropriate to splice sections of drapery support pole together. This feature is effectively provided for in the manner shown in FIG. 8. Sections 66 and 68 of drapery pole material are provided each being formed to define an internal end receptacle. The sections of drapery support pole may be of solid construction with the receptacles formed at end portions thereof, or in the alternative, the drapery support pole may be of hollow construction throughout. A structural splice member 70 is provided having a cross sectional configuration the form of a star, with elongated radiating rib members 72 extending from a central portion thereof. The splice configuration need not be star-like as shown. Other splice configurations may also be employed. The rib members provide efficient structural integrity and insure that the joint resulting is at least as strong as the sections 66 and 68 of drapery support pole. Intermediate the length of the splice member 70 is provided a splice collar 76 which is of sufficiently large dimension that it will not fit within the splice receptacles of the drapery support sections and will closely approximate the diameter of the drapery pole. The splice collar insures that each end of the splice member will penetrate to its full extent within the splice receptacles so that the resulting joint will be of sufficient structural integrity for adequate support of the draperies.

The drapery pole construction which is at times described herein as being a "system pole" employs a rigid tubular structure having a slot form in the rear portion thereof. This elongated slot extends from end to end of the tubular pole and can receive either a concealed support or other bracket or the slot can admit a specially designed rod cutter or other tool. The tubular pole member can be made rigid by means of ribs arranged longitudinally. These ribs may be of any suitable configuration, number or shape deemed appropriate to accomplish the following tasks: (a) rigidity, (b) cutability by use of a special rod cutter, (c) cutability by use of other tools, and (d) adaptability to system elbows, splices, brackets and miscellaneous components.

A rounded "lip" may be provided at the edges of the slot in the tube. This lip may be included for purposes of both rigidity and safety (since a straight edge at the slot may cause cuts to the hands).

In some applications, such as arched or bay-type windows, flexibility of the drapery support pole may be desirable. For such applications, a non-rigid tubular product may be provided. For example a "kerfed" drapery pole may provide a solution for bay windows as it would still provide the advantages of the drapery pole system incorporated herein. This system may also lend itself to a variety of shapes and styles. The drapery pole need not be simply plain and round.

Figure 9:
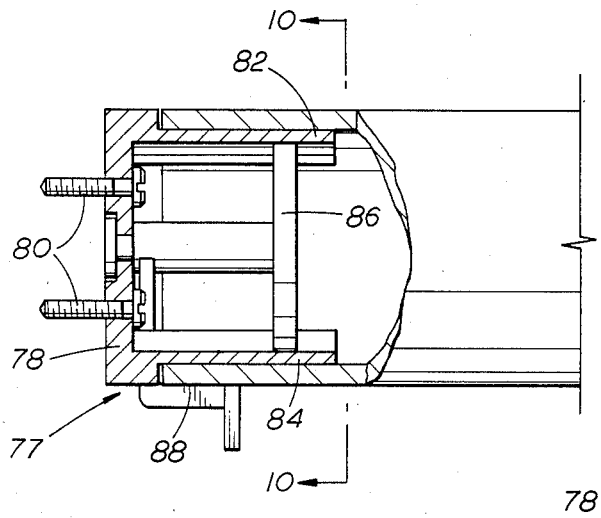
Figure 10:
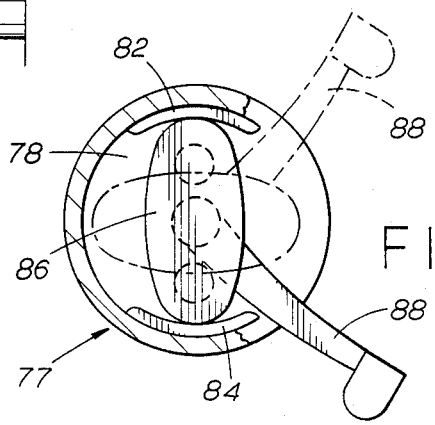

Referring now to FIGS. 9 and 10 a fixture member is provided for securing end portions of a drapery support rod to wall structures of a building. The rod support fixture, illustrated generally at 77, includes a base plate 78 which is provided with screw holes 80 to receive screws that secure the base plate to a wall surface such as the inside trim of window openings. Two or more tines 82 and 84 are secured to the base plate with the outer portions thereof being movable by means of a rotary cam 86 having a cam lever 88 for its operation. The rotatable cam applies force to the inside surfaces of the tines, forcing them outward against the inside surface of an elbow receptacle or other pole system component. This component would then be held in place by frictional forces. In the alternative, the tines could be attached to a rotatable member for movement about a stationary cam to accomplish the frictional retention described above.

With the fixture 77 in assembly with the wall structure of the building, end sections of drapery support pole are positioned such that the tines 82 and 84 enter receptacles at the end portions of the drapery support pole. The end surfaces of the drapery support pole are in substantial engagement with the base plate 78. The lever 88 is then manipulated to induce rotation to the cam member 86 thus forcing the tines 82 and 84 radially outwardly into tight friction engagement with the inner surfaces of the drapery pole receptacles. The drapery pole sections are thus positively locked in assembly with the support fittings 76. The drapery support pole in this case will typically be formed in sections with an intermediate splice such as that shown in FIG. 8 in order that relative linear movement of the pole sections may be provided for.

As shown in FIG. 11 a support fixture, shown generally at 90, may be provided as an alternative embodiment to that shown in FIGS. 9 and 10. The support fixture of FIG. 11 is of the passive pressure type wherein frictional engagement with the inner surface of an end receptacle of a drapery support pole section occurs due to the spring force of a plurality of tension tines. As shown in FIG. 11 the fixture 90 includes a base plate 92 that is adapted to be secured to the wall structure of a building by screw members similar to the manner shown in FIGS. 9 and 10. From the base plate 92 extends a plurality of tine members 94 which are composed of spring material such as spring steel or any other suitable material having a significant degree of resiliency for the purposes intended. The outer portion of the spring members 94 curve radially inwardly to insure that the tines are received within the end receptacle of a drapery pole section. As the drapery pole section is pushed into place toward the base plate 92 the spring tines will be forced radially inwardly against the spring tension thereof by the wall structure of the drapery support receptacle. The tines will exert continuous mechanical force against the inner wall surface of the drapery pole receptacle thereby insuring that the drapery support pole remains properly positioned.

Within the scope of the present invention it may be desirable to provide a compression drapery pole installation such that a drapery support pole is retained in position between spaced surfaces by means of frictional engagement. This feature is borne out in FIGS. 12 and 13. According to FIG. 12 a compression type drapery support pole is illustrated generally at 100 and includes a section of solid drapery support pole material 102 such as wood. At one end of the drapery support pole is provided a resilient cushion member 104 which may be composed of any one of a number of suitable rubber or rubber-like materials. The cushion member 104 is secured to the pole member 102 by means of a screw 106. The screw head would be inset or countersunk so as not to interact with and damage the pole surface. If desired, the drapery support pole 102 may be composed of wood or it may be composed of any one of a number of other suitable materials.

At the opposite end of the drapery support pole 102 is provided a socket sleeve 108 having a plate member 110, the plate member being secured to the opposite end of the drapery pole 102 by means of a screw member 112. Within the end portion of the socket sleeve 108 is provided a cushion support member 114 having a resilient friction cushion 116 secured to the outer portion thereof. The cushion support member 114 is movable relative to the socket sleeve 108 and is urged outwardly by means of a compression spring 118. Thus, the resilient friction pads 104 and 116 will be continually urged by the passive force of the spring 118 against the opposed surfaces of the building structure thereby positively securing the drapery support pole assembly in fixed relation with the building structure.

The rear portion of the socket sleeve 108 is slotted as shown at 120 so as to permit a lock screw 121 or other locking device to secure one end of the spring 118. The locking device may be adjusted to accomplish adjustment of the compressive force of the spring as desired for appropriate frictional retention of the poles. By cutting the wood pole to the proper length, a drapery support pole such as a 1⅜" (or other diameter) compression pole can be effectively provided.

By utilizing the compression type drapery support pole of FIGS. 12 and 13 a simple in-the-window installation can be effectively performed utilizing spring tension to secure the drapery support pole in position. Adjustments (up or down, back and forth) are simple and can be accomplished effectively to suit the needs and desires of the user. Standard diameter hardware can be effectively utilized allowing an appearance, which is pleasing and predictable. The system provides for constant-diameter along virtually the entire length of the drapery support pole. This results in a more pleasing appearance especially if portions of the drapery support pole are exposed. Since the drapery support system of FIG. 12 may incorporate a conventional section of wood drapery support pole material, a "real wood" appearance can be effectively obtained thereby providing a pleasing appearance to the user when portions of the wood pole are exposed. The rubber cushions are of the same diameter as drapery support pole thus avoiding bulges at the pole ends which could be unsightly and could make drapery installation more difficult.

According to the structure of FIG. 13, an alternative compression type drapery support pole system is illustrated generally at 122 wherein a section 124 of slotted drapery support pole material is employed in similar manner to the drapery support section 102 of FIG. 12. In this case the elongated slot 126 extends substantially the entire length of the drapery support pole and thereby enables the use of intermediate drapery supports of the manner shown in FIG. 5 for the purpose of intermediate support. To the pole section 124 is secured a resilient frictional cushion 128 which bears against an inside window surface to establish frictional engagement therewith. A sleeve socket 130 is provided which receives a cushion support 132 in movable relation therewith. The cushion support member 132 is provided with a resilient cushion member 134 which bears against the opposite spaced window frame surface. Within the socket sleeve 130 is provided a compression spring 136 which urges the friction pad support 132 toward the window surface. The socket member 130 is also slotted as shown at 138, the slot mating with the elongated slot 126 of the drapery support pole 124.

The apparatus of FIG. 13 functions according to the same principal as the drapery support pole 100 of FIG. 12. The difference being the character of the drapery support pole that is employed. The socket sleeve is retained within one end of the pole section 124 with a spring retainer plate 140 being secured by means of a lock screw or nut 142. Alternatively, the lock screw may serve as a spring stop when a retainer plate is not employed. The position of the lock screw can be adjusted within the elongated slot 126 thus altering the compression of the spring member 136 and thus altering the spring force urging the friction pads 128 and 134 into frictional engagement with the spaced window frame surfaces of the building structure.

Another embodiment of the drapery pole splice is illustrated generally at 144 in FIG. 14. A pole section 146 is provided with a pole splice element 148 defining a plurality of vanes 150 arranged in radiating relation from the center line of the splice element. The opposite pole section 152 defines a plurality of slots 154 which receives the vanes 150. This kind of splice, or one of similar nature would provide telescoping adjustment while maintaining a constant diameter. The value of maintaining a constant drapery pole diameter even across pole splices is that the drapery qathers more smoothly and shows no narrow areas. Also, the pole/-splice combination will be easier to insert through a rod pocket since the edges of the pole splice assembly will not tend to snag on the fabric and seams. Open centers 156 and 158 in FIG. 15 provide for convenient attachment to, for example, the pole support of FIG. 12 by means of a power driven screw.

Although the present invention has been directed particularly to the provision of drapery support apparatus such is not intended to be limiting to the spirit and scope hereof. It is intended that the present invention be of sufficient scope to include alternative devices such as towel racks, shower rods, display/clothing racks, closet poles, etc. without departing from the spirit or scope hereof.

In view of the foregoing it is apparent that the present invention is clearly adapted to accomplish all of the features hereinabove set forth together with other features which will become obvious and inherent from a description of the apparatus itself. It will be understood that certain combinations and subcombinations are of utility and may be employed without reference to other features and subcombinations. This is contemplated by and is within the scope of the present invention.

What is claimed:

1. A drapery pole system having a constant diameter along the length thereof, comprising:

(a) an elongated generally cylindrical drapery pole having an elongated slot extending the length thereof, said elongated slot having an undercut;

(b) intermediate hanger means adapted to extend from a wall structure and having a hook-like extremity adapted to engage within said undercut of said elongated slot to provide intermediate support for said drapery pole;

(c) elbow means at each end of said drapery pole having one end thereof joined in linearly adjustable manner to respective ends of said drapery pole, said elbow means having a substantially common diameter with said drapery pole and having a constant diameter along the length thereof; and (d) end support bracket means for attachment to a building structure, said end support bracket means forming an upwardly projecting support pin, the other end of said elbow means forming an aperture in the upper portion thereof which receives said upwardly projecting support pin thereby securing the end portions of said drapery pole system in securely supported relation.

2. A drapery pole system as recited in claim 1, wherein:

(a) said elbow means defines receptacles within said end portions thereof, said support bracket means being at least partly received within one of said receptacles, said drapery pole being received in telescopic relation within the other of said receptacles; and (b) means securing said elbow means in substantially immovable relation within said other of said receptacles.

3. A drapery pole system as recited in claim 2, wherein:

said elbow means is of hollow tubular form.

4. A drapery pole system as recited in claim 2, wherein:

said elbow means is defined by a solid structure.

5. A drapery pole system as recited in claim 2, wherein:

(a) said elbow means defines a splined connection at one of said end portions thereof; and (b) said drapery pole defines a mating splined connection receivable in telescoping relation within said splined connection.

6. A drapery pole system as recited in claim 1, wherein:

(a) said drapery pole is defined by a plurality of drapery pole sections;

(b) splined connection means being provided on said drapery pole sections, said splined connection means interfitting to form pole connection means having sufficient structural integrity for support of draperies, said splined connection means being linearly adjustable to compensate for minor errors in length of said drapery pole sections.

7. A drapery pole system as recited in claim 6, wherein said splined connection means comprises:

(a) an integral spline fitting forming an attachment plate and a plurality of spline fingers extending from said attachment plate;

(b) means for securing said attachment plate to an end surface of a drapery pole section; and (c) sleeve means extending from another drapery pole section and receiving said spline fingers in interfitting relation therein to form a drapery pole joint of structural integrity.

8. A drapery pole system as recited in claim 7, wherein:

said sleeve means define a spline receptacle receiving said spline fingers in mating relation therein.

9. A drapery pole system as recited in claim 1, wherein:

(a) said drapery pole is in the form of a plurality of pole sections forming pole joint means, said pole sections forming splice receptacle means;

(b) at each pole joint means an integral structural splice member being received within splice receptacle means of adjacent pole sections; and (c) a splice collar positioned intermediate said structural splice member and ensuring equal penetration of said splice member into each splice receptacle means.

10. A drapery pole system as recited in claim 9, wherein:

said splice member defines a plurality of elongated ribs radiating from a central portion thereof.

11. A drapery pole system as recited in claim 5, wherein:

(a) said spline connection of said elbow means is a receptacle adapted to receive spline fingers in telescoping relation therein; and (b) a spline fitting forms said mating splined connection and includes:

(1) a spline fitting having an attachment plate forming a planar surface for abutment with the planar end surface of said drapery pole;

(2) means for securing said attachment plate to said end surface of said drapery pole; and (c) a plurality of spline fingers extending from said attachment plate and being received in telescoping relation within said receptacle of said elbow means and positionable for slight adjustment of the overall length of said drapery pole system in situations where the length of said drapery pole is slightly insufficient.

12. A drapery pole system having a substantially constant diameter along the length thereof, comprising:

(a) an elongated generally cylindrical drapery pole having an elongated slot extending the length thereof, said elongated slot having an undercut;

(b) intermediate hanger means adapted to extend from a wall structure and having a hook-like extremity adapted to engage within said undercut of said elongated slot to provide intermediate support for said drapery pole;

(c) elbow means at each end of said drapery pole and having receptacle means formed at each extremity thereof, one of said receptacle means being a splined receptacle, said elbow means having a substantially common diameter with said drapery pole and having a constant diameter along the length thereof;

(d) splined connection means being provided at each extremity of said drapery pole and being received respectively within said splined receptacle means of said elbow means and being linearly adjustable relative to said elbow means in situations where the length of said drapery pole is slightly insufficient; and (e) end support bracket means for attachment to a building structure and forming an upwardly projecting support pin, the other receptacle of said elbow means forming an aperture in the upper portion thereof which receives said upwardly projecting support pin thereby securing the end portions of said drapery pole system in securely supported relation to a wall structure.

13. A drapery pole system as recited in claim 12 wherein said spline connection comprises;

(a) a splined fitting having an attachment plate forming a planar surface for abutment with the planar end surface of said drapery pole;

(b) means for securing said attachment plate to said end surface of said drapery pole; and (c) a plurality of spline fingers extending from said attachment plate and being received in telescoping relation within said splined receptacle of said elbow means and positionable for slight adjustment of the overall length of said drapery pole system in situations where the length of said drapery pole is slightly insufficient.

14. A drapery pole system as recited in claim 12 wherein:

(a) said drapery pole is defined by a plurality of drapery pole sections; and (b) splined connection means being provided on said drapery pole sections, said splined connection means interfitting to form pole connection means having sufficient structural integrity for support of draperies, said splined connection means being linearly adjustable to compensate for minor errors in length of said drapery pole sections.

15. A drapery pole system as recited in claim 14 wherein said splined connection means comprises:

(a) an integral spline fitting forming an attachment plate and a plurality of spline fingers extending from said attachment plate;

(b) means for securing said attachment plate to an end surface of a drapery pole section; and (c) sleeve means extending from another drapery pole section and receiving said spline fingers in interfitting relation therein to form a drapery pole joint of structural integrity.

16. A drapery pole system as recited in claim 12 wherein:

(a) said drapery pole is in the form of a plurality of pole sections forming pole joint means, said pole sections forming splice receptacle means;

(b) at each pole joint means an integral structural splice member being received within splice receptacle means of adjacent pole sections.

17. A drapery pole system as recited in claim 16 wherein:

said splice member define a plurality of elongated ribs radiating from a central portion thereof.

18. A drapery pole system having a substantially constant diameter along the length thereof, comprising:

(a) an elongated generally cylindrical drapery pole forming a planar end surface and having an elongated slot extending the length thereof, said elongated slot having an undercut;

(b) intermediate hanger means adapted to extend from a wall structure and having a hook-like extremity adapted to establish locking and supporting engagement within said undercut of said elongated slot to provide intermediate support for said drapery pole;

(c) elbow means at each end of said drapery pole and having receptacle means formed at each extremity thereof, one of said receptacle means being a spline receptacle, said elbow means having a substantially common diameter with said drapery pole and having a constant diameter along the length thereof, said spline receptacle of said elbow means receiving spline fingers in telescoping relation therein; and (d) a spline fitting forming mating splined connection for said elbow means and including:

(1) a splined fitting having an attachment forming a planar surface for abutment with said planar end surface of said drapery pole;

(2) means for securing said attachment plate to said end surface of said drapery pole; and (3) a plurality of spline fingers extending from said attachment plate and being received in telescoping relation within said spline receptacle of said elbow means and positionable for slight adjustment of the overall length of said drapery pole system in situations where the length of said drapery pole is slightly insufficient.

19. A drapery pole system for connection to a wall structure of a building and having a substantially constant diameter along the length thereof, comprising:

(a) an elongated drapery pole having ends forming drapery pole connections;

(b) elbows at respective ends of said drapery pole, said elbows each having a diameter substantially equaling the diameter of said drapery pole and forming drapery pole receptacles at each end thereof, one of said drapery pole receptacles receiving one of said drapery pole connections in telescoping relation therein and accommodating minor insufficiency in the overall length of said drapery pole;

(c) means securing said drapery pole sections in immovable assembly with said one of said drapery pole receptacle and (d) means receiving the other of said drapery pole receptacles and securing said elbows and said drapery pole to said wall structure.

* * * * *